US005625328A

United States Patent [19]

Coleman, Jr.

[11] Patent Number: 5,625,328

[45] Date of Patent: Apr. 29, 1997

[54] STRIPLINE DIRECTIONAL COUPLER TOLERANT OF SUBSTRATE VARIATIONS

[75] Inventor: William E. Coleman, Jr., Clearwater, Fla.

[73] Assignee: E-Systems, Inc., Dallas, Tex.

[21] Appl. No.: 529,070

[22] Filed: Sep. 15, 1995

[51] Int. Cl.[6] ..... H01P 5/18

[52] U.S. Cl. ..... 333/116; 333/246

[58] Field of Search ..... 333/115, 116

[56] References Cited

U.S. PATENT DOCUMENTS

| | | | |
|---|---|---|---|
| 3,600,707 | 8/1971 | Friedman . | |
| 3,723,913 | 3/1973 | Seidel . | |
| 3,753,167 | 8/1973 | Cohn . | |
| 3,764,941 | 10/1973 | Nick . | |
| 4,127,831 | 11/1978 | Riblet . | |
| 4,216,446 | 8/1980 | Iwer . | |
| 4,375,054 | 2/1983 | Pavio . | |
| 4,419,635 | 12/1983 | Reindel . | |
| 4,536,725 | 8/1985 | Hubler . | |
| 4,814,780 | 3/1989 | Sterns et al. . | |
| 5,008,639 | 4/1991 | Pavio . | |
| 5,032,802 | 7/1991 | Fry . | |
| 5,032,803 | 7/1991 | Koch . | |
| 5,075,646 | 12/1991 | Morse . | |
| 5,097,233 | 3/1992 | Pekarek | 333/116 |
| 5,111,165 | 5/1992 | Oldfield . | |
| 5,369,379 | 11/1994 | Fujiki . | |

FOREIGN PATENT DOCUMENTS

| | | | |
|---|---|---|---|
| 49048 | 4/1979 | Japan | 333/116 |

*Primary Examiner*—Paul Gensler
*Attorney, Agent, or Firm*—Harold E. Meier

[57] ABSTRACT

A stripline directional coupler having a quarter-wave transmission line added either between the isolation port of the coupler and the termination impedance or between the input port of the coupler and the signal input reduces the degradation of coupler directivity caused by impedance mismatch of the transmission lines with the source, load and/or termination impedances. With the transmission lines and additional quarter-wave transmission line formed on the same substrate material, coupler directivity is insensitive to the value of the characteristic impedance of the transmission lines. This allows the use of less expensive substrate materials and manufacturing processes during stripline directional coupler construction.

15 Claims, 7 Drawing Sheets

STRIPLINE DIRECTIONAL COUPLER TOLERANT OF SUBSTRATE VARIATIONS

TECHNICAL FIELD

The present invention relates to directional couplers and, in particular, to a stripline directional coupler tolerant of substrate variations.

BACKGROUND OF THE INVENTION

Stripline couplers consist generally of a pair of adjacent transmission line conductors located within one or more substrates positioned between one or more ground planes. The transmission line conductors may be coplanar or non-coplanar.

A directional coupler couples a certain amount of power input to a first transmission line to a second transmission line. The ratio of the power input to the first transmission line to the power coupled to the second transmission line is referred to as the coupling factor. For example, a directional coupler having a 10 db coupling factor couples one-tenth of the input power to the coupled port of the second transmission line (and theoretically transmits the other nine-tenths of the input power to the output of the first transmission line). Directional couplers are useful as a power dividing circuit and as a measurement tool for sampling RF and microwave energy The directivity of a directional coupler refers to the ratio of the power measured at the forward-wave sampling terminals, with only a forward wave present in the transmission line, to the power measured at the same terminals when the direction of the forward wave in the line is reversed. Directivity is usually expressed in decibels (dB). High directivity in directional couplers is usually attained by manufacturing the transmission line to have a predetermined characteristic impedance (determined by the dimensions of the strip conductor, dielectric constant of the substrate and thickness of the substrate) that matches the source impedance and/or load impedance. As such, any variations in the value of the characteristic impedance of the transmission line with respect to a source and/or load impedance degrades directivity.

Typically, in order to achieve high directivity (i.e. manufacturing the transmission line with a precise characteristic impedance—usually fifty ohms), directional couplers are manufactured using expensive substrate material (dielectric medium). Such microwave laminates, as they are commonly referred to, require special manufacturing techniques to inlay the laminate on a conventional printed circuit board. Additionally, the dielectric constant (Er) and thickness of the substrate are tightly controlled which produces a transmission line having a relatively precise characteristic impedance, thus enhancing the directivity of the directional coupler. Tight control of substrate parameters (dielectric constant, thickness, etc.) increases the cost of the directional couplers.

Accordingly, there exists a need for a directional coupler having high directivity and capable of manufacture on conventional printed circuit boards using substrates that are commonly used with conventional circuit boards. Further, there is a need for a directional coupler that allows use of less expensive substrate material that can be manufactured with higher tolerances, thus allowing the directional coupler to be manufactured on basic printed circuit boards.

SUMMARY OF THE INVENTION

According to the present invention, there is provided a stripline directional coupler having a first transmission line formed on a substrate and having two ports. The coupler further includes a second transmission line electromagnetically coupled to the first transmission line and having two ports. A quarter-wave transmission line having a first end and a second end is formed on the same substrate as the first and second transmission lines. One end of the quarter-wave transmission line is coupled to one of the two ports of the second transmission line while the other end is coupled to an impedance. The quarter wave transmission line reduces degradation of coupler directivity caused by changes in characteristic impedance of the first and second transmission lines due to substrate variations.

DESCRIPTION OF THE DRAWINGS

For a more complete understanding of the present invention and the advantages thereof, reference is made to the following detailed description taken in conjunction with the accompanying drawings wherein.

DETAILED DESCRIPTION

Figure 1A:
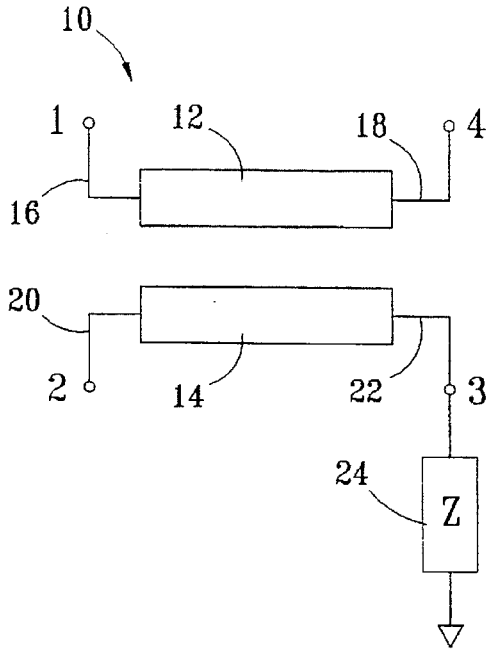
FIG. 1A (PRIOR ART)
FIG. 1A illustrates a prior art single-ended directional coupler.

With reference to the drawings, like reference characters designate like or similar parts throughout the drawings.

Figure 1B:
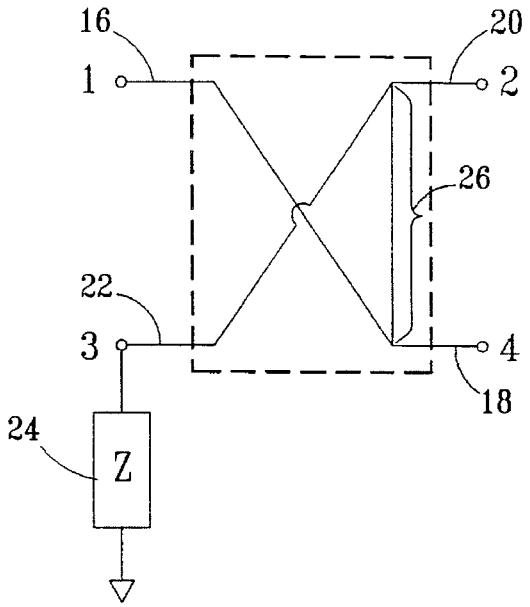
FIG. 1B (PRIOR ART)
FIG. 1B illustrates the equivalent electrical representation.

With reference to FIG. 1A, there is shown a prior art single-ended directional coupler 10 and FIG. 1B shows the equivalent electrical representation. The coupler 10 includes two adjacent transverse-electromagnetic mode (TEM) transmission lines 12 and 14, each having two ports. Propagation of an input signal along one of the transmission lines induces the propagation of a coupled signal in the other transmission line. The transmission line 12 has an input port 16 for receiving an input signal from an external source (not shown) and a thru port 18. The transmission line 14 has a coupled port 20 and an isolation port 22. A coupled signal induced along the transmission line 14 by the propagation of a signal in the transmission line 12 appears at the coupled port 20. The coupled signal is induced within a coupling region 26 of the directional coupler 10.

In general, the signal emitted from the thru port 18 has an amount of power equal to the amount of power received at the input port 16 minus the amount of power coupled to the coupled port 20, assuming an ideal lossless coupler 10. While the isolation port 22 of the transmission line 14 emits no signal, reflected energy due to impedance mismatching of the transmission lines with a load impedance (not shown) at the thru port 18 appears at the isolation port 22. Conventionally, the isolation port is terminated by a termination impedance 24 that is normally equal to the characteristic impedance of the transmission line 14. Typically, this impedance is 50 ohms resistive.

Figure 1C:
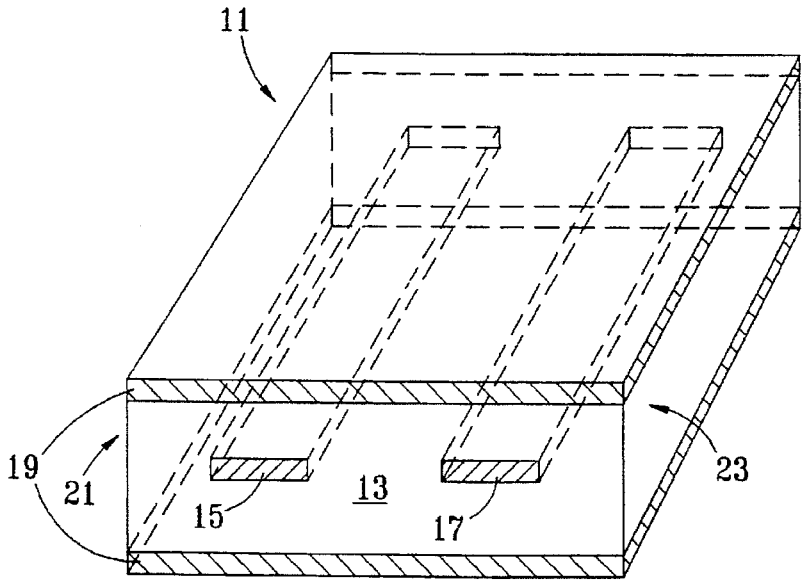
FIG. 1C (PRIOR ART)
FIG. 1C illustrates a directional coupler including a substrate.

Now referring to FIG. 1C, there is illustrated one of several possible configurations of coupled transmission lines of a coupler 11 used in the present invention. The coupler 11 includes a substrate 13 positioned between reference planes 19 and a first strip conductor 15 and a second strip conductor 17. One transmission line 21 includes the first conductor 15, the substrate 13 and the reference planes 19 while another transmission line 23 includes the second conductor 17, the substrate 13 and the reference planes 19.

Figure 2A:
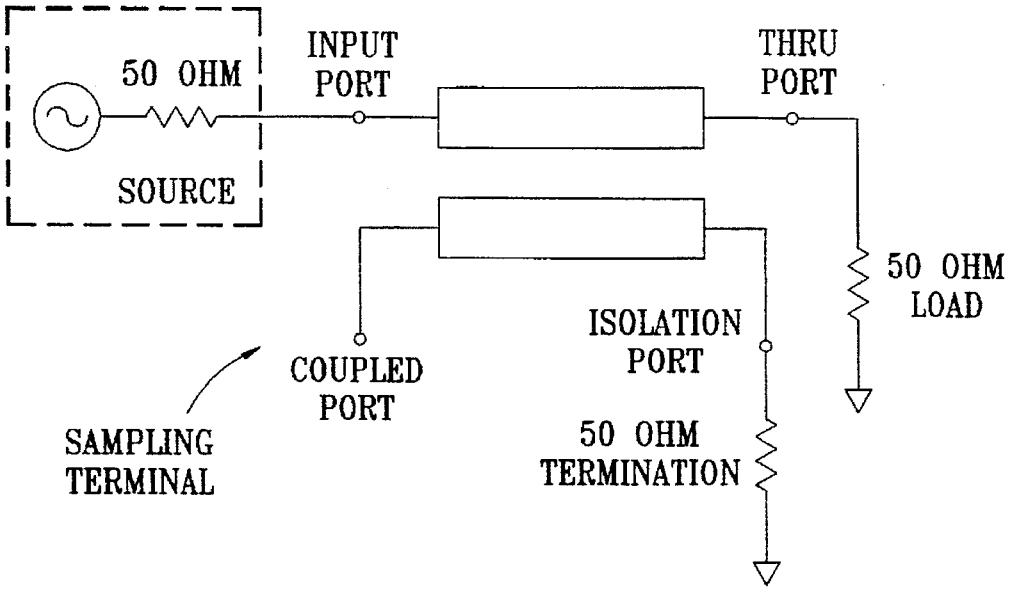
FIG. 2A illustrates a conventional configuration of a single-ended directional coupler for sampling or measuring the forward coupled power.

Now referring to FIG. 2A, there is shown a conventional configuration of a single-ended directional coupler for sampling or measuring the forward coupled power. Ideally, the characteristic impedance of the coupled transmission lines is equal to the load, source and termination impedance (50 ohms). Under these circumstances, the transmission lines are matched to the load impedance and no reflections occur in the system. However, under normal conditions, impedance mismatching exists due mainly to the inaccuracies in the characteristic impedance of the transmission lines, source impedance, load impedance and/or termination impedance. As will be discussed below, unwanted reflections result when the characteristic impedance of the transmission lines is not matched to the source and load impedances.

Assuming the source and load impedances are fifty ohms resistive and the value of the characteristic impedance of the transmission lines is not equal to fifty ohms, power will be reflected at different points in the system. Basic operation of the coupler provides a forward power signal ("forward power") traveling from the input port to the thru port. The forward power induces a signal in the coupled transmission line that travels in the direction from the isolation port to the coupled port. Accordingly, the forward power is coupled to the coupled port. The magnitude of the coupled forward power depends on the coupling factor of the directional coupler.

As the forward power travels from the input port to the thru port and to the load impedance, a certain amount of power is reflected ("Reflection 1A") from the load impedance back toward the input port. The magnitude of Reflection 1A is dependent on the reflection coefficient which is related to the impedance mismatch of the transmission line to the load impedance.

As Reflection 1A travels from the thru port to the input port, a certain amount of power is reflected from the source impedance back toward the thru port ("Reflection 2A"). The magnitude of Reflection 2A depends on the reflection coefficient that is related to the impedance mismatch of the transmission line with the source impedance. Reflection 2A, in turn, induces a signal in the coupled transmission line that travels in the direction from the isolation port to the coupled port. Accordingly, Reflection 2A is coupled to the coupled port with the magnitude of the coupled Reflection 2A also depending on the coupling factor. Accordingly, at this time the signal at the coupled port includes both the coupled forward power and the coupled Reflection 2A power.

Meanwhile, Reflection 1A induces a signal in the coupled transmission line that travels in the direction from the coupled port to the isolation port. Reflection 1A is coupled to the isolation port and the magnitude of the coupled Reflection 1A depends on the coupling factor. As the coupled Reflection 1A travels from the coupled port to the isolation port and to the termination impedance, a certain amount of power is reflected from the termination impedance back toward the coupled port ("Reflection 3A"). The magnitude of Reflection 3A depends on a reflection coefficient that is related to the impedance mismatch of the coupled transmission line with the termination impedance.

While an infinite number of reflections occur theoretically, the magnitude of these other reflections are very small and generally do not have any effect. Accordingly, the signal sampled or measured at the coupled port, referred to as the coupled forward power, consists mainly of the coupled forward power, the coupled Reflection 2A, and the Reflection 3A. As will be appreciated, assuming the characteristic impedance of each of the transmission lines are approximately equal and the source, load and termination impedances are substantially equal to one another, the magnitudes of coupled Reflection 2A and Reflection 3A will also be approximately equal.

Figure 2B:
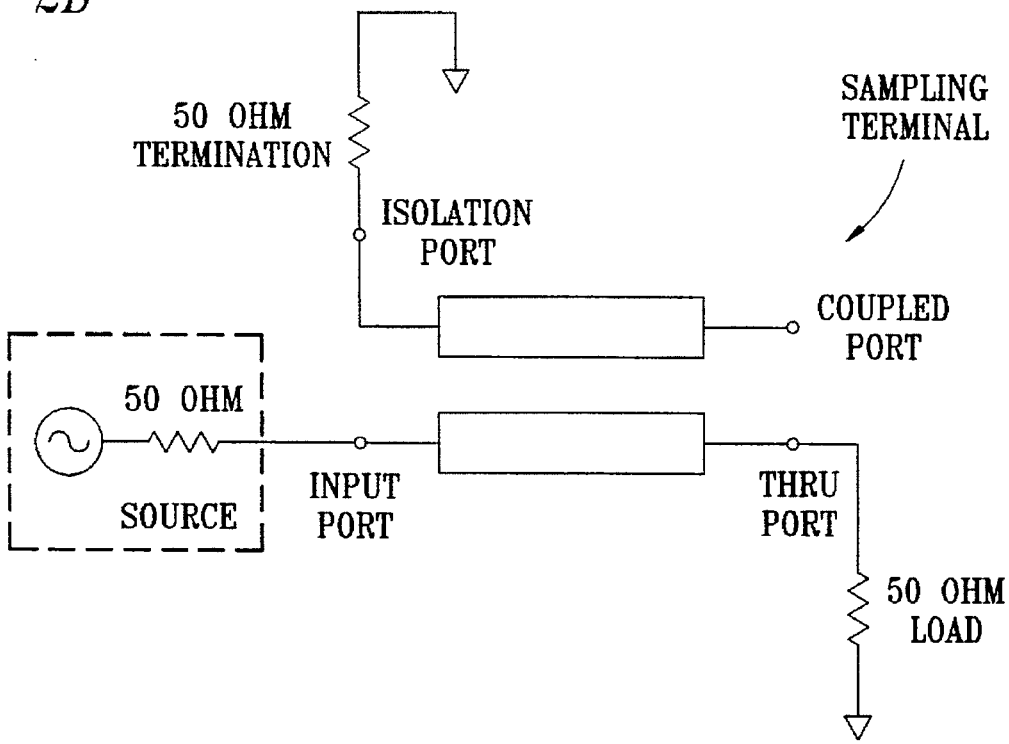
FIG. 2B illustrates a conventional configuration of a single-ended directional coupler for sampling or measuring the reflected coupled power.

Now referring to FIG. 2B, there is shown a conventional configuration of a single-ended directional coupler for sampling or measuring the reflected coupled power. Forward power is coupled to the isolation port. The coupled forward power produces a reflection ("Reflection 1B") at the termination load when there is an impedance mismatch. Reflection 1B propagates toward, and appears at, the coupled port. Meanwhile, a certain amount of forward power is reflected ("Reflection 2B") from the load impedance back toward the input port. Reflection 2B induces a signal in the coupled transmission line that travels in the direction from the isolation port to the coupled port. Reflection 2B is coupled to the coupled port. Accordingly, Reflection 1B and coupled Reflection 2B appear at the coupled port. As will be appreciated, the magnitudes of Reflection 1B and coupled Reflection 2B will be approximately equal, assuming the load and termination impedances are approximately equal.

It will be understood, however, that undesired reflections present at the reflected coupled port (configuration of FIG. 2B) have a larger effect on the measurement of the reflected coupled power as compared to the impact of undesired reflections on the measurement of the coupled forward power (configuration of FIG. 2A). This is due mainly to the generally smaller magnitude of any reflected coupled power measured at the reflected coupled port. The accuracy of the measurement of the "true" reflected power is substantially reduced by the unwanted reflections caused by the impedance mismatch of the transmission lines with the load impedance (at the thru port) and termination impedance (at the isolation port). As such, the "true" coupled reflected power represents the measurement of the reflection caused by a difference in impedance between the load impedance and the termination impedance. Ideally, changes in load impedance would be detected regardless of the value of the characteristic impedance of the transmission lines. Accordingly, in certain applications, controlling or negating the measurement of unwanted reflections is more important at the coupled reflected port than at the coupled forward port.

In accordance with the present invention, the addition of at least a one quarter-wave transmission line to the directional coupler reduces the impact of "secondary reflections" (Reflections 2A and 3A in the configuration shown in FIG. 2A; Reflections 1B and 2B in the configuration shown in FIG. 2B) present at the sampled or measured port (i.e. coupled port). These secondary reflections are caused by the impedance mismatch of the coupler transmission lines with the source, load and/or termination impedances. The added quarter-wave transmission line is formed on the same substrate as the two transmission lines of the coupler, and with the same process. This results in approximately equal characteristic impedances. While any fluctuations in the substrate material or process tolerances occurring during manufacture may increase or decrease the characteristic impedance, all the transmission lines have approximately the same characteristic impedance. Having approximately equal characteristic impedances among the transmission lines (quarter-wave and coupler) reduces the degradation of directivity caused by characteristic impedance mismatch of the transmission lines with the source, load or termination impedances.

The addition of the quarter-wave line increases directivity of the coupler by changing the phase of one of the secondary reflections by 180 degrees. As set forth in the discussion above regarding the configuration shown in FIG. 2A, the secondary reflections Reflection 2A and Reflection 3A are approximately equal in magnitude. Accordingly, changing the phase by 180 degrees of either Reflection 2A or Reflection 3A will cancel the other reflection. Therefore, the signal sampled or measured at the coupled port provides a more accurate measurement of the "true" coupled forward power, without the effect of reflections caused by the mismatch of the transmission line with the source, load and/or termination impedances.

Only when the source, load and/or termination impedances are not matched will the measured coupled forward power vary. Accordingly, the present invention provides a means for detecting impedance mismatching between the source, load and/or termination impedances independent of the value of characteristic impedance of the transmission lines. As such, the impedance of a load and reflected power can be effectively monitored. The present invention provides a directional coupler whose directivity is insensitive to the value of the characteristic impedance of the transmission lines. Accordingly, production of coupler transmission lines having fairly precise characteristic impedances is not required. This same principle also operates for the coupler configuration shown in FIG. 2B when measuring the "true" coupled reflected power.

Figure 3A:
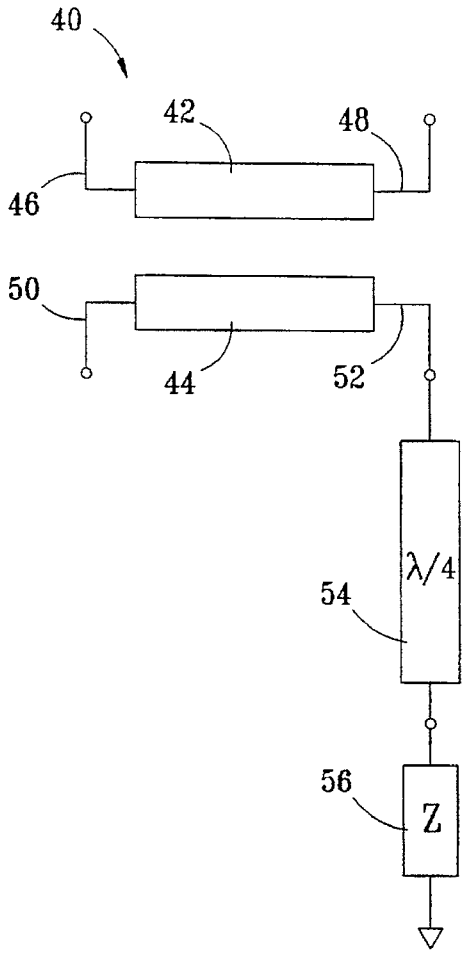
FIG. 3A illustrates a single-ended directional coupler in accordance with the present invention.

Now referring to FIG. 3A, there is illustrated a single-ended directional coupler 40 in accordance with the present invention. The coupler 40 includes a transmission line 42 and a transmission line 44, with each transmission line having two ports and including the same substrate or dielectric material. The transmission line 42 has an input port 46 and a thru port 48, while the transmission line 44 has a coupled port 50 and an isolation port 52. Coupled to the isolation port 52 is one end of a quarter-wave transmission line 54 that includes the same substrate or dielectric material as the transmission lines 42, 44. The transmission line 54 is a quarter-wave transmission line having a length equal to a quarter wavelength of the center frequency $f_o$. Coupled to the other end of the transmission line 54 is a termination impedance 56 typically having a value of fifty ohms resistive.

As will be understood, the value of the termination impedance 56 may be any value depending on the desired performance and characteristics of the coupler and desired source and load impedances. In the preferred embodiment, the desired value of the characteristic impedance of the transmission lines 42, 44 and 54 is fifty ohms. As such, a properly matched coupler will have transmission lines with characteristic impedances matching the source impedance (coupled to the input port 46, not shown), load impedance (coupled to the thru port 48, not shown) and termination impedance (coupled to the isolation port 52). However, due to substrate variations and manufacturing process tolerances for which the present invention allows, the characteristic impedance will most likely vary between 40 and 60 ohms. According to one embodiment of the present invention, as shown in FIG. 3A, the quarter-wave transmission line 54 is added between the isolation port 52 and the load impedance 56.

The addition of the quarter-wave transmission line 54 reduces the degradation of coupler directivity caused by variations in the desired characteristic impedance of the two transmission lines 42 and 44 due to substrate variations (e.g. dielectric constant, thickness, etc.) and production tolerances (e.g. strip conductor dimensions). This allows manufacture of directional couplers with less expensive substrate material and less accurate manufacturing processes. Due to unwanted tolerances in the dielectric constant of the substrate, variations in thickness during manufacture, and variations in the stripline conductors during manufacture, the characteristic impedances of the transmission lines will not be exactly fifty ohms, unless expensive materials and high cost manufacturing processes are utilized.

Since the transmission lines 42, 44 and 54 are manufactured on the same substrate and according to the same process, the characteristic impedances of each will be approximately equal. This, in turn, produces reflection coefficients (caused by the mismatch of the transmission lines with any coupled impedances) that are approximately equal. The addition of the quarter-wave transmission line 54 transforms the reflection normally occurring at the load impedance 56 (without the transmission line 54) into a reflection that is 180 degrees out of phase. In sum, the addition of a quarter-wave transmission line produces a directional coupler whose directivity is insensitive to the value of the characteristic impedance of the transmission lines.

Figure 3B:
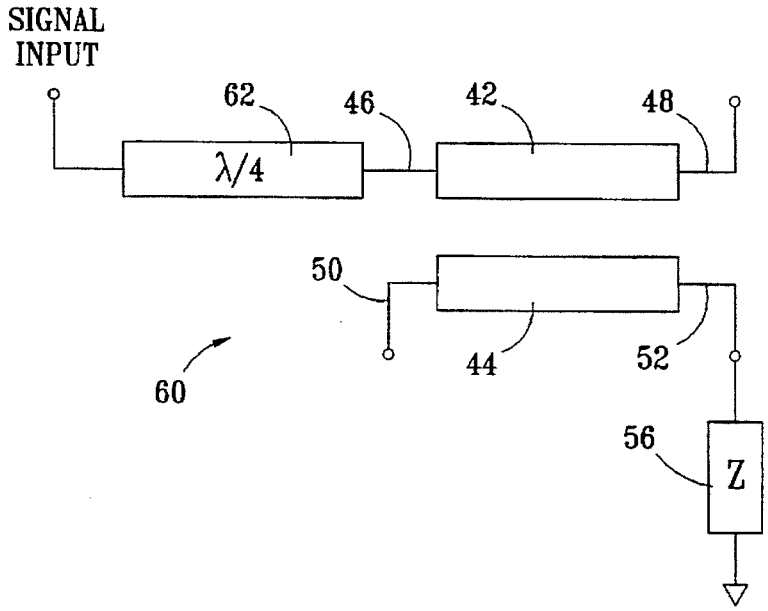
FIG. 3B illustrates a first alternative embodiment of the single-ended directional coupler in accordance with the present invention.

Now referring to FIG. 3B, there is shown a first alternative embodiment of a single-ended directional coupler 60 in accordance with the present invention. Instead of coupling the quarter-wave transmission line between the isolation port 52 and the load impedance 56, a quarter-wave transmission line 62 is added between the signal input and the input port 46 of the coupler 60. As will be appreciated, this alternative configuration performs under the same basic principles as the coupler 40 illustrated in FIG. 3A and produces the desired results.

Figure 3C:
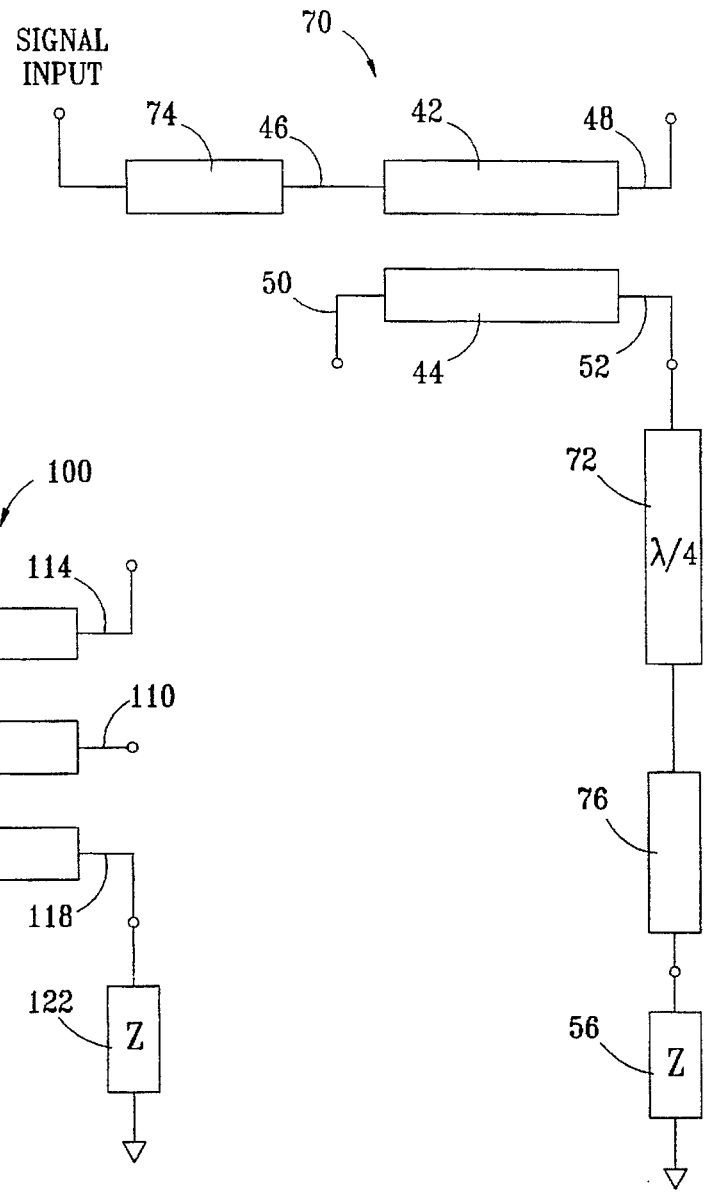
FIG. 3C illustrates a second alternative embodiment of the single-ended directional coupler in accordance with the present invention.

Now referring to FIG. 3C, there is shown a second alternative embodiment of a single-ended directional coupler 70 in accordance with the present invention. Due to possible layout concerns, an input port extension transmission line 74 of any length is coupled between the signal input and the input port 46. This input port extension transmission line 74 may be required, or desired, for a particular layout. Accordingly, another extension transmission line 76 having the same length as the input port extension line 74 is added to a quarter-wave transmission line 72 coupled between the isolation port 52 and the termination impedance 56.

As will be understood, the added transmission line 76 couples to the quarter-wave transmission line 72 and produces an integrated transmission line (72 plus 76) having a length that is a quarter-wave longer than the length of the input port extension line 74. In other words, the difference in length between the length of the input port extension line 74 and the length of the transmission line coupled between the isolation port 52 and the termination impedance 56 is a quarter-wavelength (or odd multiple thereof, e.g. (5/4) lambda, (9/4) lambda, etc.). As will be appreciated, this alternative configuration performs under the same basic principles as the coupler 40 illustrated in FIG. 3A and produces the desired results. Accordingly, the coupler 70 reduces degradation of coupler directivity due to variations in transmission line characteristic impedance while allowing flexibility in designing the layout patterns accompanying the coupler.

Figure 4:
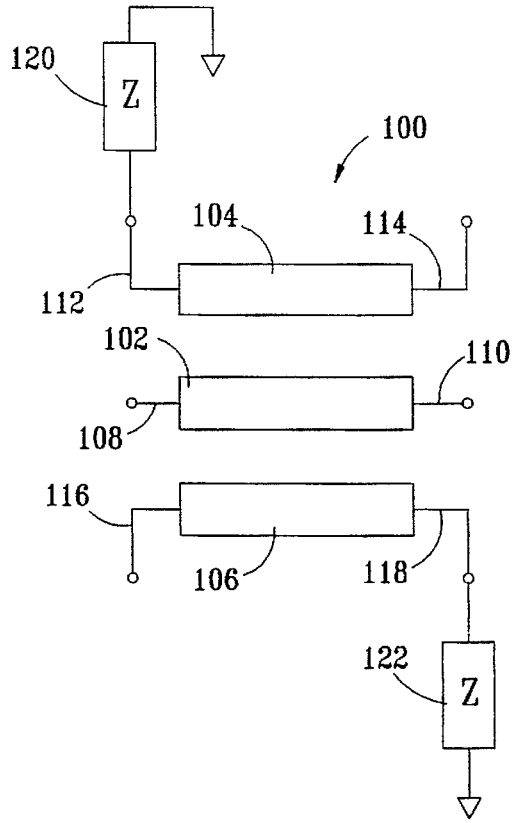
FIG. 4 (PRIOR ART)
FIG. 4 illustrates a prior art dual directional coupler.

Now referring to FIG. 4, there is shown a prior art dual directional coupler 100. The coupler 100 includes three adjacent transverse-electromagnetic mode (TEM) transmission lines 102, 104 and 106, each having two ports. Propagation of an input signal along one of the transmission lines induces the propagation of a coupled signal in another adjacent transmission line. The transmission line 102 has an input port 108 for receiving an input signal from an external source (not shown) and a thru port 110. The transmission line 106 has a coupled port 116 and an isolation port 118. The transmission line 104 has a coupled port 114 and an isolation port 112. Generally, forward coupled power is sampled or measured at the coupled port 116 while reflected coupled power is sampled or measured at the coupled port 114.

Conventionally, the isolation port 118 is terminated with a termination impedance 122 while the isolation port 114 is terminated with a termination impedance 120. Typically, the termination impedances 120 and 122 are equal to 50 ohms with the characteristic impedance of the transmission lines 102, 104 and 106 also equal to 50 ohms.

Figure 5A:
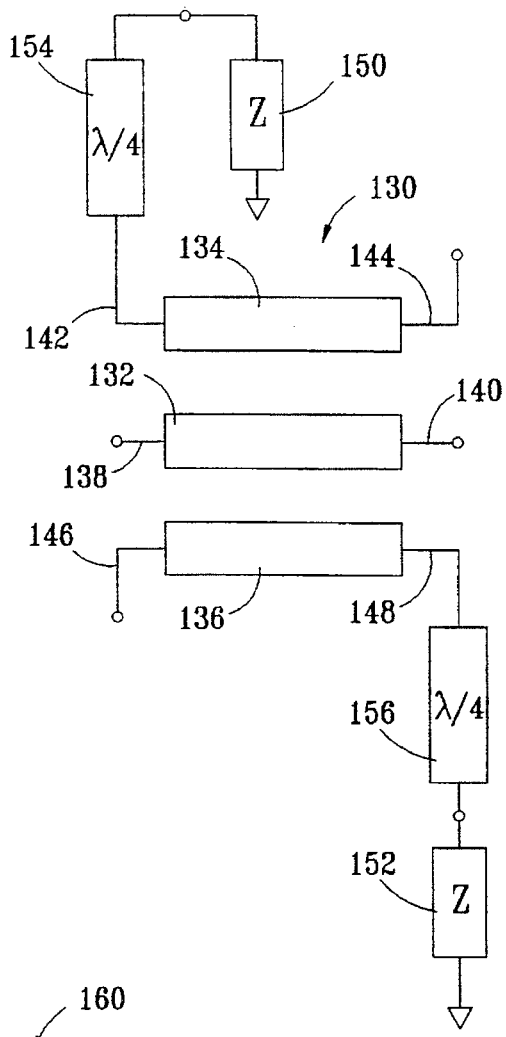
FIG. 5A illustrates a dual directional coupler in accordance with the present invention.

Now referring to FIG. 5A, there is illustrated a dual directional coupler 130 in accordance with the present invention. The coupler 130 includes a transmission line 132, a transmission line 134 and a transmission line 136, with each transmission line having two ports and including the same substrate or dielectric material. The transmission line 132 includes an input port 138 and a thru port 140. The transmission line 134 includes an isolation port 142 and a coupled port 144, while the transmission line 134 has a coupled port 146 and an isolation port 148.

Coupled to the isolation port 148 is one end of a quarter-wave transmission line 156 that includes the same substrate or dielectric material as the transmission lines 132, 134 and 136. The transmission line 156 is a quarter-wave transmission line having a length equal to a quarter wavelength at the center frequency $f_o$. Coupled to the other end of the transmission line 156 is a termination impedance 152 typically having a value of fifty ohms resistive.

Coupled to the isolation port 142 is one end of a quarter-wave transmission line 154 that includes the same substrate or dielectric material as the transmission lines 132, 134 and 136. The transmission line 154 is a quarter-wave transmission line having a length equal to a quarter wavelength at the center frequency $f_o$. Coupled to the other end of the transmission line 154 is a termination impedance 150 typically having a value of fifty ohms resistive.

In the most basic application, the transmission lines 132 and 136 provide a tool for measuring the forward power (delivered by a generator connected to the input port 138, not shown) at the coupled port 146. Similarly, the transmission lines 134 and 136 provide a tool for measuring the reflected power (reflected from a load connected to the thru port 140, not shown) at the coupled port 144. The addition of the quarter-wave transmission line 156 reduces degradation of coupler directivity, with respect to the measurement of forward coupled power, due to variations in transmission line characteristic impedance caused by substrate variations and manufacturing tolerances. Likewise, the addition of the quarter-wave transmission line 154 also reduces the degradation of coupler directivity with respect to the measurement of reflected coupled power. As will be understood, the dual directional coupler 130 may include only one added quarter-wave transmission line or may include both.

Figure 5B:
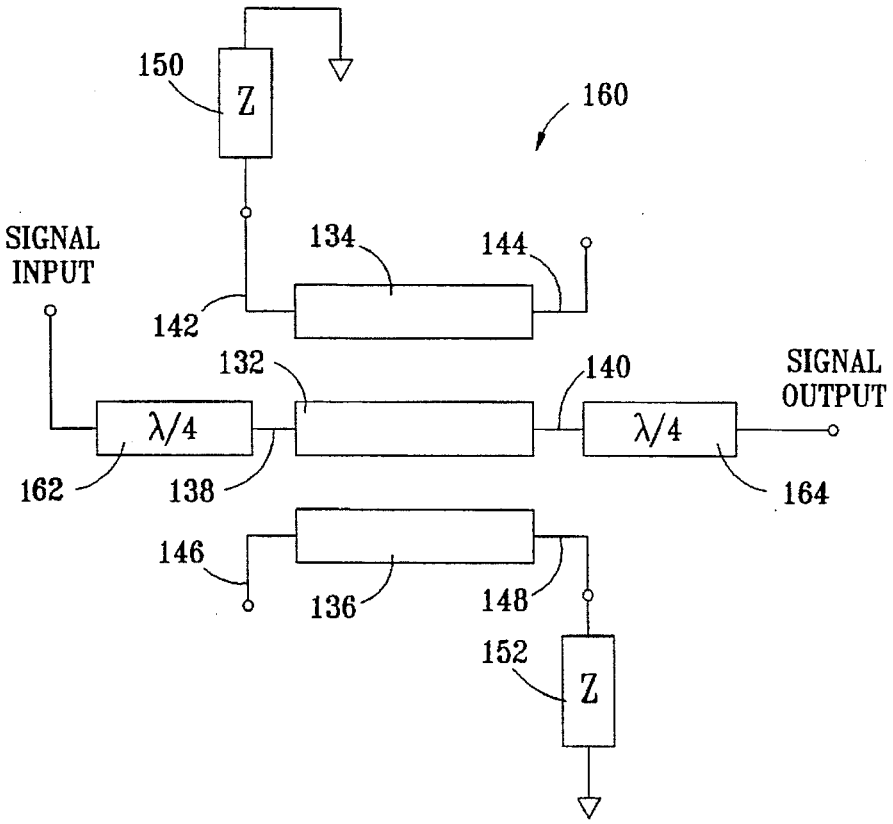
FIG. 5B illustrates a first alternative embodiment of the dual directional coupler in accordance with the present invention.

Now referring to FIG. 5B, there is shown a first alternative embodiment of a dual directional coupler 160 in accordance with the present invention. Instead of coupling a quarter-wave transmission line between the isolation port 142 and the termination impedance 150, a quarter-wave transmission line 162 is added between the signal input and the input port 138 of the coupler 160. Also, instead of coupling a quarter-wave transmission line between the isolation port 148 and the termination impedance 152, a quarter-wave transmission line 164 is added between the signal output and the thru port 140 of the coupler 160. As will be appreciated, this alternative configuration performs under the same basic principles as the coupler 130 illustrated in FIG. 5A and produces the desired results.

Figure 5C:
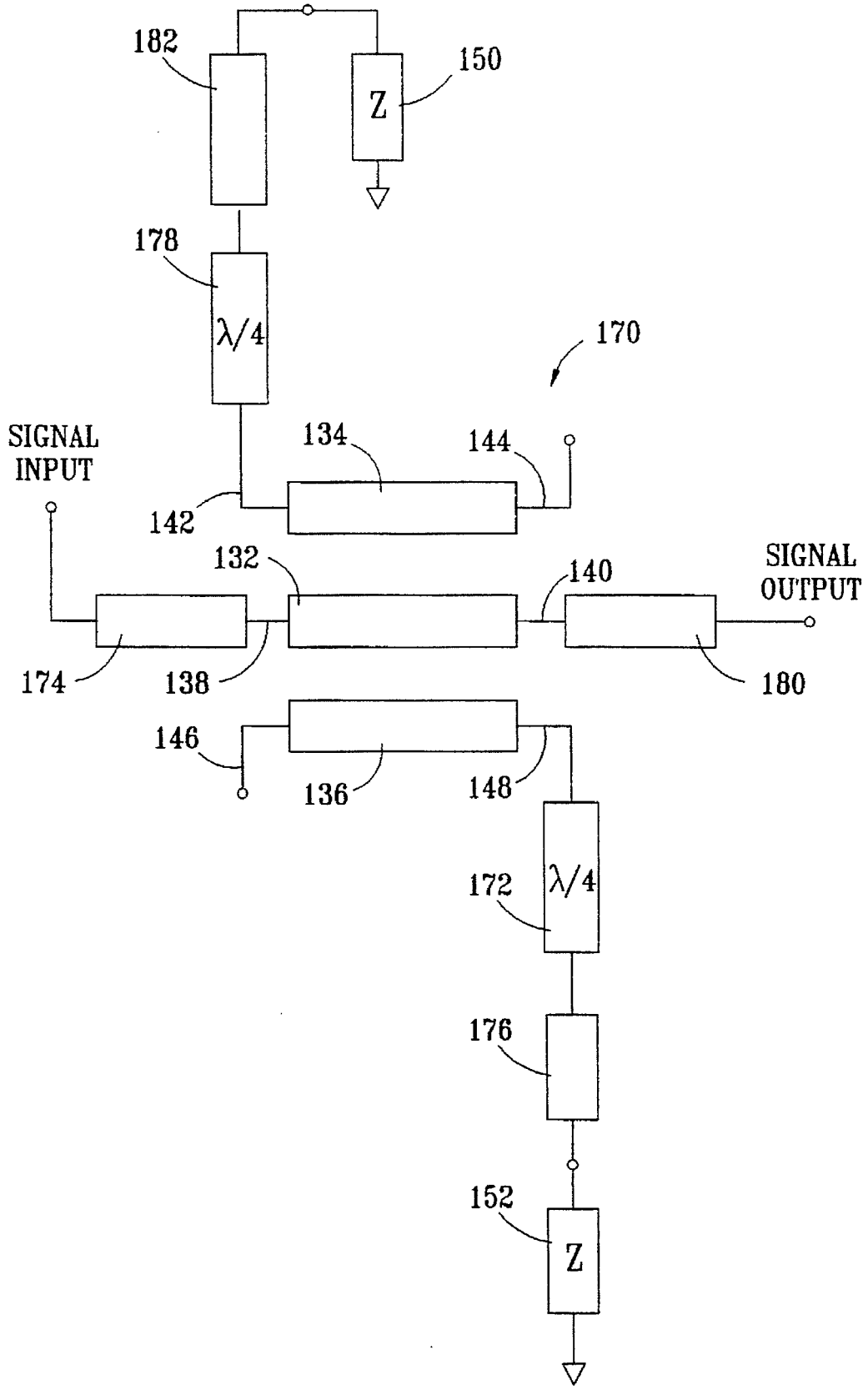
FIG. 5C illustrates a second alternative embodiment of the dual directional coupler in accordance with the present invention.

Now referring to FIG. 5C, there is shown a second alternative embodiment of a dual directional coupler 170 in accordance with the present invention. Similar to the coupler illustrated in FIG. 3C, an input port extension transmission line 174 of any length is coupled between the signal input and the input port 138. This input port extension transmission line 174 may be required, or desired, for a particular layout. Accordingly, another extension transmission line 176 having the same length as the input port extension line 174 is added to a quarter-wave transmission line 172 coupled between the isolation port 148 and the termination impedance 152.

As will be understood, the added transmission line 176 coupled to the quarter-wave transmission line 172 produces an integrated transmission line (172 plus 176) having a length that is a quarter-wave longer than the length of the input port extension line 174. In other words, the difference in length between the length of the input port extension line 174 and the length of the transmission line coupled between the isolation port 148 and the termination impedance 152 is a quarter-wavelength (or odd multiple thereof, e.g. (5/4) lambda, (9/4) lambda, etc.).

Likewise, a thru port extension transmission line 180 of any length is coupled between the signal output and the thru port 140. This thru port extension transmission line 180 may be required, or desired, for a particular layout. Accordingly, another extension transmission line 182 having the same length as the thru port extension line 180 is added to a quarter-wave transmission line 178 coupled between the isolation port 142 and the termination impedance 150. As will be appreciated, this alternative configuration performs under the same basic principles as the coupler 130 illustrated in FIG. 5A and produces the desired results.

Figure 6:
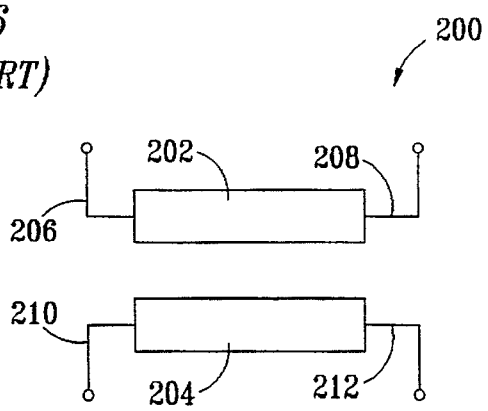
FIG. 6 (PRIOR ART)
FIG. 6 illustrates a prior art bi-direction directional coupler.

Now referring to FIG. 6, there is shown a prior art bi-direction directional coupler 200. The coupler 200 includes two adjacent transverse-electromagnetic mode (TEM) transmission lines 202 and 204, each having two ports. Propagation of an input signal along one the transmission lines induces the propagation of a coupled signal in another adjacent transmission line. The transmission line 202 has an first port 206 and a second port 208. The transmission line 204 has a first port 210 and second port 212.

Figure 7A:
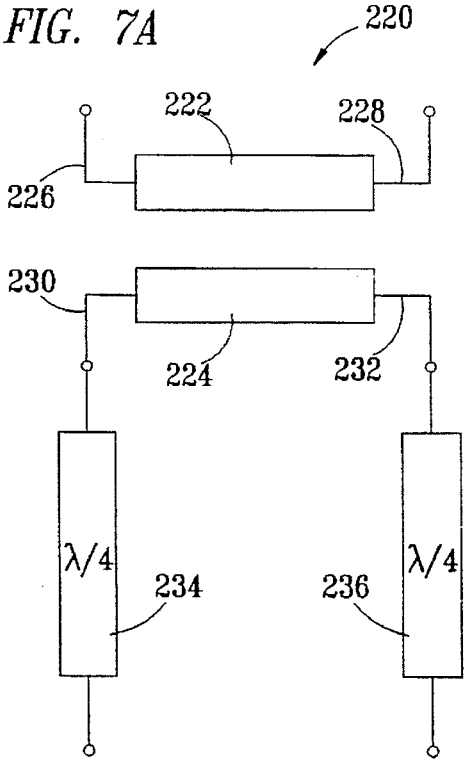
FIG. 7A illustrates a bi-direction directional coupler in accordance with the present invention.

Now referring to FIG. 7A, there is illustrated a bi-direction directional coupler 220 in accordance with the present invention. The coupler 220 includes a transmission line 222 having a first port 226 and a second port 228 and a transmission line 224 having a first port 230 and a second port 232. Coupled to the first port 230 is one end of a quarter-wave transmission line 234 that includes the same substrate or dielectric material as the transmission lines 222 and 224. The transmission line 234 is a quarter-wave transmission line having a length equal to a quarter wavelength at the center frequency $f_o$. Coupled to the second port 232 is one end of a quarter-wave transmission line 236 also includes the same substrate or dielectric material as the transmission lines 222 and 224. The transmission line 236 is a quarter-wave transmission line having a length equal to a quarter wavelength at the center frequency $f_o$.

Figure 7B:
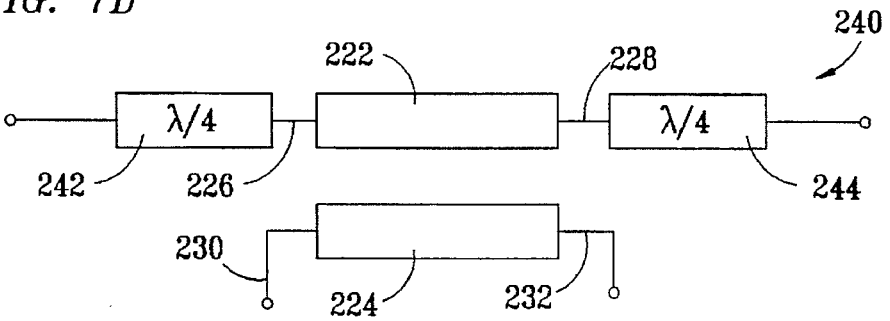
FIG. 7B illustrates an alternative embodiment of the bi-direction directional coupler in accordance with the present invention.

Now referring to FIG. 7B, there is shown an alternative embodiment of a dual directional coupler 240 in accordance with the present invention. Instead of coupling a one quarter-wave transmission line to the first port 230 and another quarter-wave transmission line to the second port 232, a quarter-wave transmission line 242 is coupled to first port 226 of the coupler 240 while a quarter-wave transmission line 244 is coupled to the second port 228 of the coupler 240. As will be appreciated, this alternative configuration performs under the same basic principles as the coupler 220 illustrated in FIG. 7A and produces the desired results.

Figure 8:
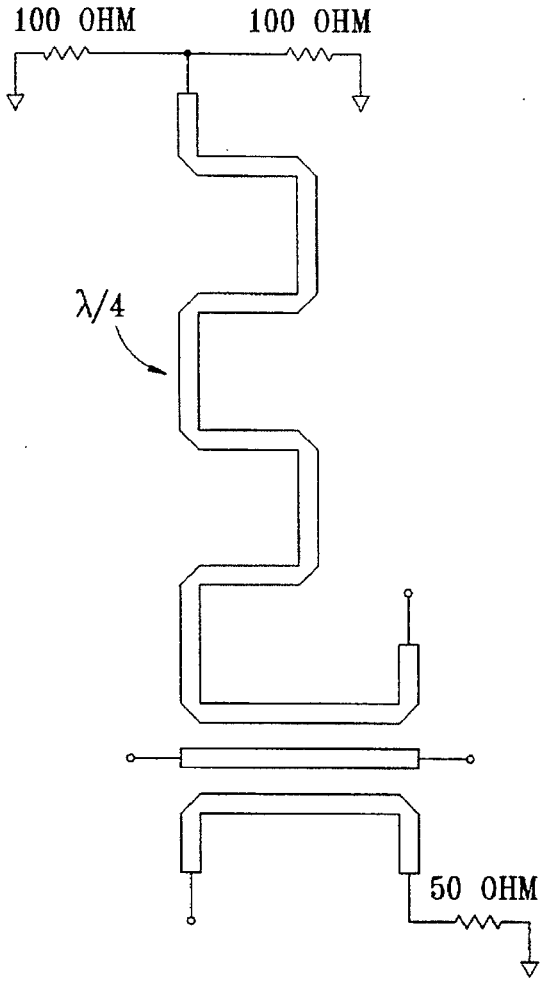
FIG. 8 is a partial schematic diagram of a dual directional coupler used in an RF system.

Now referring to FIG. 8, there is illustrated a coupler in accordance with the present invention as part of a transmit/receive switch circuit board. Without the quarter-wave transmission line in the circuit, the directivity of the forward coupled port of the coupler measured approximately between 25 and 26 dB with a frequency ranging from 225 MHz to 400 MHz at a center frequency of 300 MHz. With the added quarter-wave transmission line as shown in FIG. 8, the directivity of the reflected coupled port of the coupler measured approximately between 31 and 38 dB with a frequency ranging from 225 MHz to 400 MHz at a center frequency of 300 MHz.

In this specific embodiment, the center frequency is 300 MHz and the length of the coupled transmission lines is about 0.9 inches with the length of the quarter-wave line between 4 and 5 inches.

While the improvement in directivity diminishes as the coupler is used over wider bandwidths, the reduction in degradation of coupler directivity due to variations in transmission line characteristic impedance resulting from substrate variations and manufacturing process tolerances is still significant over fairly wide bandwidths.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention.

What is claimed is:

1. A stripline directional coupler tolerant of substrate material and process variations, the coupler comprising:

a first transmission line comprising a substrate material and defining an input port and a thru port;

a second transmission line electromagnetically coupled to the first transmission line and defining a coupled port and an isolation port wherein said second transmission line comprises the same substrate material as the first transmission line;

a third transmission line electromagnetically coupled to the first transmission line and defining a coupled port and an isolation port wherein said third transmission line comprises the same substrate material as the first transmission line; and a first quarter-wave transmission line comprising the same substrate material as the first transmission line and coupled between the isolation port of the second transmission line and a first impedance.

2. A stripline directional coupler in accordance with claim 1 further comprising:

a second quarter-wave transmission line comprising the same substrate material as the first transmission line and coupled between the isolation port of the third transmission line and a second impedance.

3. A stripline directional coupler comprising:

a first transmission line comprising a substrate material and defining an input port and a thru port;

a second transmission line electromagnetically coupled to the first transmission line and defining a coupled port and an isolation port wherein said second transmission line comprises the same substrate material as the first transmission line;

a third transmission line having a predetermined length and coupled between a signal input and the input port of the first transmission line; and a fourth transmission line coupled between the isolation port of the second transmission line and a load wherein the length of the third transmission line and the length of the fourth transmission line differ by a quarter wavelength.

4. A stripline directional coupler comprising:

a substrate;

a first transmission line comprising an input port and a thru port and including said substrate;

a second transmission line electromagnetically coupled to the first transmission line, the second transmission line comprising a coupled port and an isolation port and wherein the second transmission line includes said substrate;

a first quarter-wave transmission line including said substrate and having a first end and a second end, the first end of the first quarter-wave transmission line coupled to the isolation port of the second transmission line, the second end of the quarter-wave transmission line coupled to a first termination impedance;

an input port extension transmission line including said substrate and coupled between a signal input and the input port of the first transmission line and having a predetermined length; and a termination extension transmission line having a predetermined length substantially equal to the length of the input port extension transmission line and including said substrate and coupled between the isolation port of the second transmission line and the termination impedance and in series with the first quarter-wave transmission line.

5. A directional coupler in accordance with claim 4 comprising:

a third transmission line electromagnetically coupled to the first transmission line and having a coupled port and an isolation port and wherein said third transmission line includes said substrate; and a second quarter-wave transmission line including said substrate and having a first end and a second end said first end of the second quarter-wave transmission line coupled to the isolation port of the third transmission line and said second end of the second quarter-wave transmission line coupled to a second termination impedance.

6. A stripline directional coupler comprising:

a substrate;

a first transmission line comprising an input port and a thru port and including said substrate;

a second transmission line electromagnetically coupled to the first transmission line, the second transmission line comprising a coupled port and an isolation port and wherein the second transmission line includes said substrate;

a first quarter-wave transmission line including said substrate and having a first end and a second end, the first end of the quarter-wave transmission line coupled to the isolation port of the second transmission line, the second end of the quarter-wave transmission line coupled to a first impedance;

a third transmission line electromagnetically coupled to the first transmission line and having a coupled port and an isolation port wherein said third transmission line includes said substrate; and a second quarter-wave transmission line including the substrate and having a first end and a second end, said first end coupled to the isolation port of the third transmission line and said second end coupled to a second impedance.

7. A directional coupler in accordance with claim 6 further comprising:

an input port extension transmission line including said substrate and coupled between a signal input and the input port of the first transmission line and having a predetermined length;

a thru port extension transmission line including said substrate and coupled between the thru port of the first transmission line and a signal output and having a predetermined length;

a first termination extension transmission line having a predetermined length substantially equal to the length of the input port extension transmission line and including said substrate and coupled between the isolation port of the second transmission line and the first impedance and in series with the first quarter-wave transmission line; and a second termination extension transmission line having a predetermined length substantially equal to the length of the thru port extension transmission line and including said substrate and coupled between the isolation port of the third transmission line and the second impedance and in series with the second quarter-wave transmission line.

8. A directional coupler in accordance with claim 6 further comprising:

an input extension transmission line including said substrate and coupled between a signal input and the input port of the first transmission line and having a predetermined length; and a second extension transmission line having a predetermined length substantially equal to the length of the input port extension transmission line and including said substrate and coupled between the isolation port of the second transmission line and the termination impedance and in series with the first quarter-wave transmission line.

9. A directional coupler tolerant of substrate material and process variations, the coupler comprising:

a first transmission line defining an input port and a thru port;

a second transmission line electromagnetically coupled to the first transmission line and defining a first coupled port and a first isolation port;

a third transmission line electromagnetically coupled to the first transmission line and defining a second coupled port and a second isolation port; and a first quarter-wave transmission line coupled between the isolation port of the second transmission line and a first impedance.

10. A directional coupler in accordance with claim 9 further comprising:

a second quarter-wave transmission line coupled between the isolation port of the third transmission line and a second impedance.

11. A directional coupler in accordance with claim 10 further comprising:

a first extension transmission line coupled to the first quarter-wave transmission line and in series with the first impedance; and, a second extension transmission line coupled to the second quarter-wave transmission line and in series with the second impedance.

12. A directional coupler in accordance with claim 9 further comprising:

a first extension transmission line coupled between a signal input and the input port of the first transmission line and having a predetermined length; and a second extension transmission line having a predetermined length substantially equal to the length of the input port extension transmission line coupled between a signal output and the thru port.

13. A directional coupler comprising:

a first transmission line including an input port and a thru port;

a second transmission line electromagnetically coupled to the first transmission line and defining a first coupled port and a first isolation port;

a third transmission line electromagnetically coupled to the first transmission line and defining a second coupled port and a second isolation port;

a first quarter-wave transmission line coupled between a signal input and the input port of the first transmission line; and a second quarter-wave transmission line coupled between a signal output and the thru port of the first transmission line.

14. A directional coupler comprising:

a first transmission line including an input port and a thru port;

a second transmission line electromagnetically coupled to the first transmission line and defining a first coupled port and a first isolation port;

a third transmission line electromagnetically coupled to the first transmission line and defining a second coupled port and a second isolation port;

a first extension transmission line coupled between a signal input and the input port of the first transmission line;

a termination impedance;

a first quarter-wave transmission line coupled to the isolation port of the third transmission line; and a second extension transmission line substantially equal in length to the first extension transmission line the second extension transmission line coupled between the first quarter-wave transmission line and the termination impedance.

15. A directional coupler comprising:

a first transmission line including an input port and a thru port;

a second transmission line electromagnetically coupled to the first transmission line and defining a first coupled port and a first isolation port;

a third transmission line electromagnetically coupled to the first transmission line and defining a second coupled port and a second isolation port;

a first extension transmission line coupled between a signal output and the thru port of the first transmission line;

a termination impedance;

a first quarter-wave transmission line coupled to the isolation port of the second transmission line; and a second extension transmission line substantially equal in length to the first extension transmission line, the second extension transmission line coupled between the first quarter-wave transmission line and the termination impedance.

* * * * *